US005405463A

United States Patent [19]

Shimomura et al.

[11] Patent Number: 5,405,463

[45] Date of Patent: Apr. 11, 1995

[54] CONTINUOUS ANNEALING PROCESS OF PRODUCING COLD ROLLED MILD STEEL SHEET EXCELLENT IN DEEP DRAWABILITY AND AGING RESISTIBILITY

[75] Inventors: Takayoshi Shimomura; Osamu Nozoe; Masataka Sakoh, all of Fukuyama, Japan

[73] Assignee: Nippon Kokan Kabushiki Kaisha, Tokyo, Japan

[21] Appl. No.: 124,384

[22] Filed: Sep. 20, 1993

Related U.S. Application Data

[63] Continuation of Ser. No. 8,881, Jan. 14, 1993, abandoned, which is a continuation of Ser. No. 890,364, May 22, 1992, abandoned, which is a continuation of Ser. No. 727,312, Jul. 1, 1991, abandoned, which is a continuation of Ser. No. 593,474, Oct. 1, 1990, abandoned, which is a continuation of Ser. No. 430,087, Oct. 31, 1989, abandoned, which is a continuation of Ser. No. 309,031, Feb. 9, 1989, abandoned, which is a continuation of Ser. No. 193,148, May 3, 1988, abandoned, which is a continuation of Ser. No. 902,061, Aug. 26, 1986, abandoned, which is a continuation of Ser. No. 779,608, Sep. 23, 1985, abandoned, which is a continuation of Ser. No. 315,230, Oct. 26, 1981, abandoned.

[30] Foreign Application Priority Data

Oct. 24, 1980 [JP] Japan ..... 55-148293

[51] Int. Cl.[6] ..... C21D 8/02

[52] U.S. Cl. ..... 148/603; 148/661; 148/624

[58] Field of Search ..... 148/320, 603, 624, 661

[56] References Cited

U.S. PATENT DOCUMENTS

| | | | |
|---|---|---|---|
| 3,839,095 | 10/1974 | Kubotera et al. | 148/12 C |
| 3,879,232 | 4/1975 | Gonda et al. | 148/12 C |
| 4,336,080 | 6/1982 | Nakaoka et al. | 148/12 C |

FOREIGN PATENT DOCUMENTS

| | | | |
|---|---|---|---|
| 135616 | 10/1979 | Japan | 148/12 C |
| 77910 | 6/1980 | Japan | 148/12 C |
| 94446 | 7/1980 | Japan | 148/12 C |

OTHER PUBLICATIONS

Bramfitt et al, "Mettalurgy of Continuous-Annealed Sheet Steel", 1982, pp. 1-32 (article by Mould).

Pradhan, "Technology of Continuously Annealed Cold-Rolled Sheet Steel", 1984, Proceedings of symposium held at the TMS-AIME Fall Meeting in Detroit, pp. 3, 6 & 7 (article by Matsudo et al).

*Primary Examiner*—Deborah Yee

*Attorney, Agent, or Firm*—Frishauf, Holtz, Goodman & Woodward

[57] ABSTRACT

Deep drawability and aging resistibility as required are imparted to cold rolled steel sheet by controlling the amount of C, starting temperatures of rapid cooling and cooling rate in a proposed continuous annealing process.

18 Claims, 2 Drawing Sheets

CONTINUOUS ANNEALING PROCESS OF PRODUCING COLD ROLLED MILD STEEL SHEET EXCELLENT IN DEEP DRAWABILITY AND AGING RESISTIBILITY

This application is a continuation of application Ser. No. 08/008,881, filed Jan. 14, 1993, (abandoned); which is a continuation of application Ser. No. 07/890,364, filed May 22, 1992, (abandoned); which is a continuation of application Ser. No. 07/727,312, filed Jul. 1, 1991, (abandoned); which is a continuation of application Ser. No. 07/593,474, filed Oct. 1, 1990, (abandoned); which is a continuation of application Ser. No. 07/430,087, filed Oct. 31, 1989, (abandoned); which is a continuation of application Ser. No. 07/309,031, filed Feb. 9, 1989, (abandoned); which is a continuation of application Ser. No. 07/193,148, filed May 3, 1988, (abandoned); which is a continuation of application Ser. No. 06/902,061, filed Aug. 26, 1986, (abandoned); which is a continuation of application Ser. No. 06/779,608, filed Sep. 23, 1985, (abandoned); which is a continuation of application Ser. No. 06/315,230, filed Oct. 26, 1981, (abandoned).

For cold rolled mild steel sheet for use in the outer cover of automobiles, box annealed Al killed steel is mainly used because of problems involved with press formability and aging resistibility (occurrence of stretcher strain and others by aging). Since the box annealing depends upon slow heating and slow cooling, it takes considerably long time and is inefficient in productivity. In view of those circumstances, a continuous annealing process has recently been established for providing the drawing quality, and this process is featured by high productivity.

In general, the continuous annealing is characterized by rapid heating and rapid cooling. However, much solute C remains due to the rapid cooling after the continuous annealing in comparison with the box annealing of the slow cooling. Accordingly, the final product has disadvantage of hard property and inferior aging resistibility. For countermeasures to lower the remaining solute C, the continuous annealing process subjects a heated and soaked steel to the rapid cooling (available coolings are water quenching, roll quenching, boiling water quenching or gas jet cooling), and subsequently maintains the steel at temperatures of 300° to 500° C. for a determined period of time to precipitate supersaturated C. In spite of such rapid cooling and overaging treatment, the solute C inevitably remains in the final product, because the cooling is done rapidly after the overaging treatment, and this causes bad aging property. That is, although the continuously annealed steel has, just after production, the same mechanical properties as the box annealed Al killed steel, it has often been effected, at pressing after several months, with press defects such as cracks, neckings or stretcher strain due to deterioration by the aging or recovery of yield point elongation. There have been proposals for controlling those defects in the continuous annealing process. For example, one is to considerably reduce C in the molten steel (Japanese Laid Open Patent Specification No. 58,333/80), or the other is to add a carbide or nitride such as Ti or Zr (Japanese Patent Publications No. 31,531/75 and No. 3,884/77). However, those methods have still problems in regard to mass production in place of the box annealed Al killed steel owing to the high cost or other factors in the stable production of ultra extra low C steel and addition of carbide or nitride formers.

The present invention has been developed in view of such circumstances for attaining the object of producing cold rolled mild steel through the continuous annealing process, which is excellent deep drawability and aging resistibility of the conventional box annealed Al killed steel, by combination of controlling the chemical composition and regulating the heating cycle of the continuous annealing.

DETAILED DESCRIPTION OF THE INVENTION

The subject slab by continuous casting molten steel which has controlled C 0.01 to 0.03%, Mn 0.05 to 0.30%, sol.Al 0.020 to 0.100% and N not more than 0.0050%, subjecting the slab to a finish hot rolling at temperatures of more than 830° C., carrying out a descaling treatment after coiling it at more than 650° C., performing cold rolling to cold reduce of more than 60%, and subsequently in the continuous annealing line, soaking the cold rolled steel at temperatures between above the $A_1$ transformation point and under the $A_3$ transformation point for more than 10 seconds, cooling from the temperature of above 650° C. at the cooling rate of more than 200° C./sec, and subjecting the steel sheet to an overaging treatment. Further, 0.0005 to 0.0050% B is added to said molten steel and the continuous annealing is done thereon in the same heating cycle.

The reasons for specifying the chemical composition follow.

Figure 1:
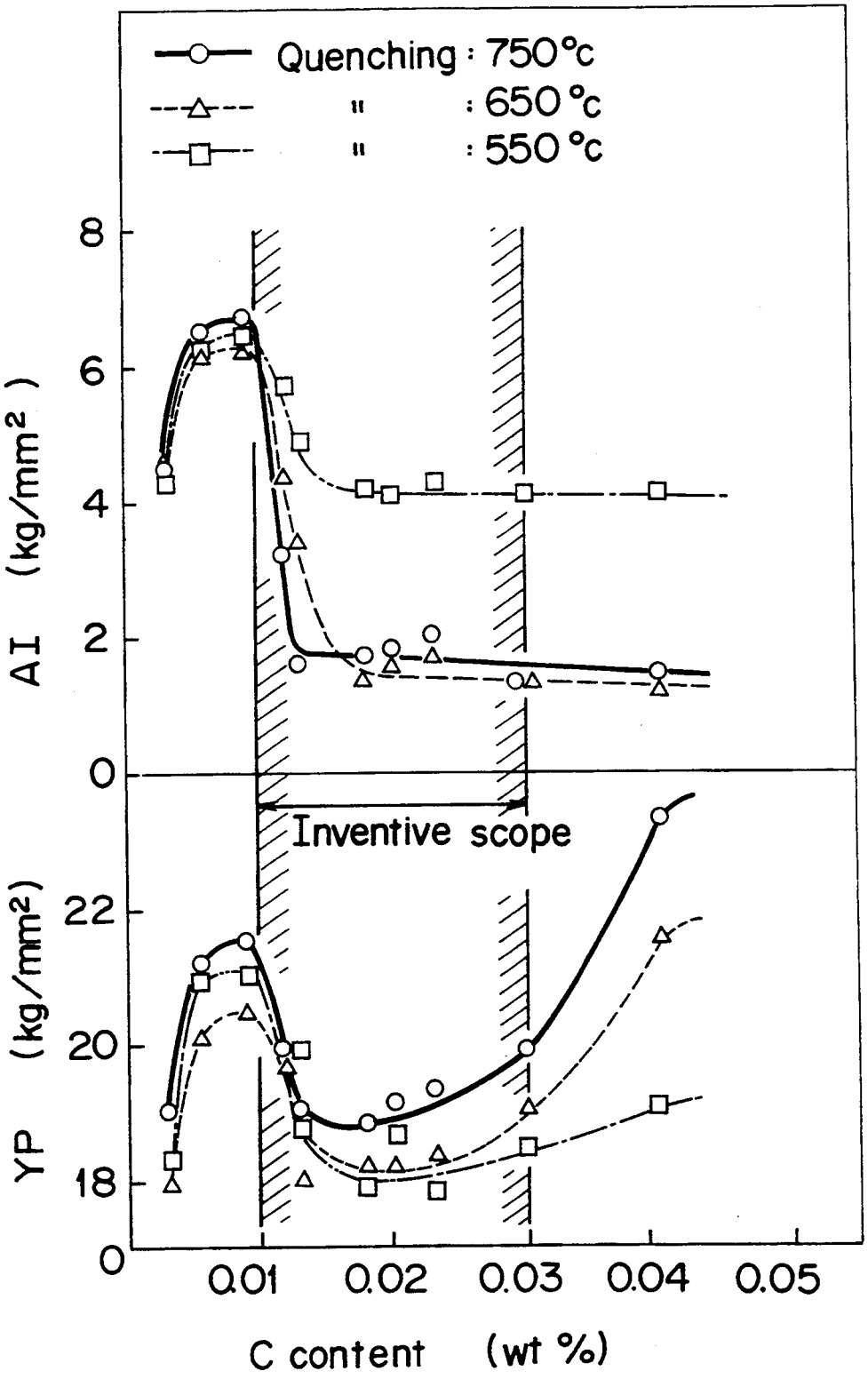
FIG. 1 is a graph showing the relationship of in the quenching temperatures of continuous annealing between C content, yield point (YP) and aging index (AI)

0.01 to 0.03%C; this is an important element, as well as the starting temperature of the rapid cooling in continuous annealing. FIG. 1 shows the relation between C content, the yield point and the aging index of the final product. In the scope of 0.01 to 0.03%, the yield point is the minimum, and the aging index is rapidly lowered with $\geqq$0.01%C and becomes constant. However C is all made solute with <0.01%, and if the steel were quenched at the temperature as high as more than 650° C., martensite would not be generated, and supersaturated solute C is low in comparison with C$\geqq$0.01%, and if the overaging treatment were carried out, supersaturate solute C would not be fully precipitated so that aging resistibility is made worse and yield point is made high. With respect to C>0.03%, if the steel were quenched into the water from the high temperature, martensite would be much generated so that the aging resistibility is improved, but the strength level is rapidly heightened and ductility is disadvantageously lowered. Therefore, taking into consideration the aging resistibility and the mechanical properties after production, the most preferably range of C is 0.01 to 0.03% where the martensite is present in an amount most suitable for meeting both requirements.

0.05 to 0.30%Mn: the lower the better for providing a soft material, but the lower limit is 0.05% for the surface property and hot brittleness. More than 0.30%Mn makes the steel hard and the deep drawability lower.

0.020 to 0.100% sol.Al: this is the scope of the ordinary Al killed steel. If sol.Al were <0.020%, AlN would be delayed in precipitation, and growth of ferrite grain would be unsatisfactory. If precipitation occurred, ferrite grain size becomes fine. On the other hand, >0.100% sol.Al invites high cost and makes the final product rather hard because of solid solution hardening.

Not more than 0.005%N: the lower is the better, and the maximum is 0.0050%. When more than 0.0050%, much AlN is precipitated and hardens the materials.

0.0005 to 0.0050%B: this is added for adjusting the grains at the hot rolling. Addition in this scope acts to hinder growth of grains by fine B precipitation, and influences grains to have diameters in the hot rolled sheet of a size preferable for the deep drawability of the final product. When <0.0005%, the effect of the B could not be displayed, and when >0.0050% it brings about brittleness and invites cracks at the edges of the slab, and the final product is hard and the ductility is worse.

This invention uses the slab of the molten steel which has been controlled within the above mentioned chemical composition. In the hot rolling, the finishing temperature is above 830° C., and if it were under this temperature, $\bar{r}$ value would be lowered. The coiling temperature is above 650° C. for completing AlN precipitation and cohesion. The hot rolled coil is subjected to the cold rolling with the cold reduction of more than 60% after the pickling or mechanical descaling treatment. The continuous annealing heats the steel up to the range $(\alpha+\gamma)$ which is above $A_1$ transformation point but under $A_3$ transformation point maintains it for more than 10 seconds in order to complete the recrystallization, rapidly cools from the temperature of above 650° C. at the cooling rate of more than 200° C./sec and overages the strip by maintaining it at the temperatures between 300° and 500° C. for more than 30 seconds so as to precipitate supersaturated solute C. The instant continuous annealing is characterized by generating the martensite by performing the rapid cooling from the range $(\alpha+\gamma)$. It is known from examples of the high tensile strength steel sheet that co-existence of ferrite and martensite considerably suppresses the aging at the room temperature. In the invention, it has been found that by combination of the optimum C range and starting temperature of the rapid cooling, martensite is properly distributed, so that the product is made with the satisfactory aging resistibility and excellent mechanical properties. The reason for specifying the starting temperature above 650° C. and the cooling rate more than 200° C./sec, is that if being outside of these range in the C range of this invention, martensite would not be generated.

With respect to the heating-soaking temperatures of the continuous annealing, being above $A_3$ transformation point, the texture is made random, thereby to rapidly reduce the deep drawability and the total elongation, and being under $A_3$ transformation point, the ferrite grain size becomes larger at the part of higher temperatures, thereby to soften the materials and increases the deep drawability, accordingly. With respect to the starting temperature, if rapidly cooling from less than 650° C., martensite does not appear and the microstructure becomes ferrite+pearlite, so that improvement of the aging resistibility could not be promised. Being above 650° C., martensite appears and the aging resistibility could e improved, and if cooling from the high temperatures as 750° C., the material becomes more or less hard. Therefore, the preferable range of the starting temperature of rapid cooling is between 650° C. and 750° C.

EXAMPLE 1

The steels having the chemical compositions shown in Table 1 were slabbed through the continuous casting. In the hot rolling, the slab was carried out with the finish rolling at 870° C. and finished in strip of 2.8 mm and coiled at 700° C. The sample was taken from the middle position of the hot strip and in the laboratory it was descaled by pickling with hydrochloride acid and reduced by cold rolling to 0.8 mm in thickness (71.4% cold reduction) with the laboratory cold rolling mill. The continuous annealing simulation test was made in the salt bath. The continuous annealing cycle was to heat 850° C., maintain 1.5 min, take out from the salt bath, air cool, quench into a jet stream of water from the temperatures of (A)750° C., (B)650° C. and (C)550° C., overage 350° C.×2 min, and temper roll at reduction of 1.0% with the laboratory cold rolling mill. Tests were made to determine the mechanical properties and FIG. 1 shows the test result.

TABLE 1

| | Chemical composition (wt %) | | | | | | | |
|---|---|---|---|---|---|---|---|---|
| No. | C | Si | Mn | P | S | N | SolAl | |
| 1 | 0.003 | 0.02 | 0.21 | 0.012 | 0.016 | 0.0033 | 0.063 | |
| 2 | 0.006 | 0.02 | 0.27 | 0.014 | 0.016 | 0.0037 | 0.036 | |
| 3 | 0.009 | 0.01 | 0.22 | 0.012 | 0.013 | 0.0041 | 0.045 | |
| 4 | 0.012 | 0.02 | 0.20 | 0.013 | 0.014 | 0.0048 | 0.045 | inventive steel |
| 5 | 0.013 | 0.02 | 0.23 | 0.015 | 0.013 | 0.0028 | 0.035 | inventive steel |
| 6 | 0.018 | 0.01 | 0.18 | 0.011 | 0.021 | 0.0029 | 0.042 | inventive steel |
| 7 | 0.020 | 0.01 | 0.16 | 0.010 | 0.010 | 0.0020 | 0.068 | inventive steel |
| 8 | 0.023 | 0.02 | 0.26 | 0.010 | 0.021 | 0.0033 | 0.052 | inventive steel |
| 9 | 0.030 | 0.01 | 0.20 | 0.011 | 0.020 | 0.0034 | 0.062 | inventive steel |
| 10 | 0.040 | 0.02 | 0.15 | 0.014 | 0.017 | 0.0037 | 0.044 | |

EXAMPLE 2

The steels having the chemical compositions shown in Table 2 were slabbed through the continuous casting. The slab was carried out with the hot rolling under the conditions of finishing 870° C. and coiling 700° C. (finishing thickness: 2.8 mm), and the steel was coiled. This hot rolled coil was descaled by pickling with hydrochloride acid, and cold rolled to thickness of 0.8 mm with the tandem mill. The continuous annealing was performed under the conditions shown in Table 3. The line speed was 100 m/min. After the heating-soaking, the steel was quenched into the water from the annealing temperatures shown in Table 3. After pickling, neutralizing, washing and drying, the overaging treatment was done between 400° C. and 300° C., followed by the temper rolling at a reduction rate of 0.8 to 1.0%. The material was sampled, and the test results are shown in Table 3.

TABLE 2

| No. | Chemical composition (wt %) C | Si | Mn | P | S | N | SolAl | B | |
|---|---|---|---|---|---|---|---|---|---|
| 11 | 0.005 | 0.01 | 0.17 | 0.012 | 0.015 | 0.0028 | 0.048 | — | |
| 12 | 0.015 | 0.02 | 0.15 | 0.014 | 0.018 | 0.0025 | 0.037 | — | Inventive steel |
| 13 | 0.022 | 0.01 | 0.20 | 0.010 | 0.015 | 0.0031 | 0.053 | — | " |
| 14 | 0.044 | 0.01 | 0.14 | 0.011 | 0.012 | 0.0027 | 0.050 | — | |
| 15 | 0.025 | 0.01 | 0.41 | 0.019 | 0.017 | 0.0027 | 0.044 | — | |
| 16 | 0.018 | 0.02 | 0.18 | 0.012 | 0.018 | 0.0058 | 0.056 | — | |
| 17 | 0.020 | 0.02 | 0.15 | 0.011 | 0.020 | 0.0033 | 0.061 | 0.0022 | Inventive steel |

TABLE 3

| No. | A B | A C | YS Kg/mm² | TS Kg/mm² | El % | AI Kg/mm² | F | |
|---|---|---|---|---|---|---|---|---|
| 11A | 850° C. | 650° C. | 17.8 | 29.5 | 50.3 | 5.8 | 1.78 | |
| 11B | 750° C. | 650° C. | 18.4 | 30.2 | 50.5 | 5.6 | 1.64 | |
| 12A | 850° C. | 750° C. | 18.5 | 31.4 | 48.5 | 1.6 | 1.75 | Inventive steel |
| 12B | 850° C. | 650° C. | 17.9 | 31.1 | 49.2 | 1.7 | 1.73 | " |
| 13A | 850° C. | 650° C. | 18.1 | 31.3 | 48.8 | 1.4 | 1.75 | " |
| 13B | 750° C. | 650° C. | 18.7 | 32.0 | 48.1 | 1.6 | 1.67 | " |
| 13C | 700° C. | 550° C. | 20.4 | 32.8 | 46.2 | 4.1 | 1.52 | |
| 14A | 850° C. | 650° C. | 21.5 | 34.6 | 43.3 | 1.3 | 1.48 | |
| 15A | 850° C. | 650° C. | 20.3 | 33.7 | 45.8 | 1.8 | 1.54 | |
| 16A | 850° C. | 650° C. | 20.6 | 33.6 | 44.7 | 2.0 | 1.57 | |
| 17A | 850° C. | 650° C. | 17.6 | 30.7 | 47.8 | 1.9 | 1.69 | Inventive steel |

A: Continuous annealing conditions
B: Heating temperatures
C: Quenching temperatures

EXAMPLE 3

Figure 2:
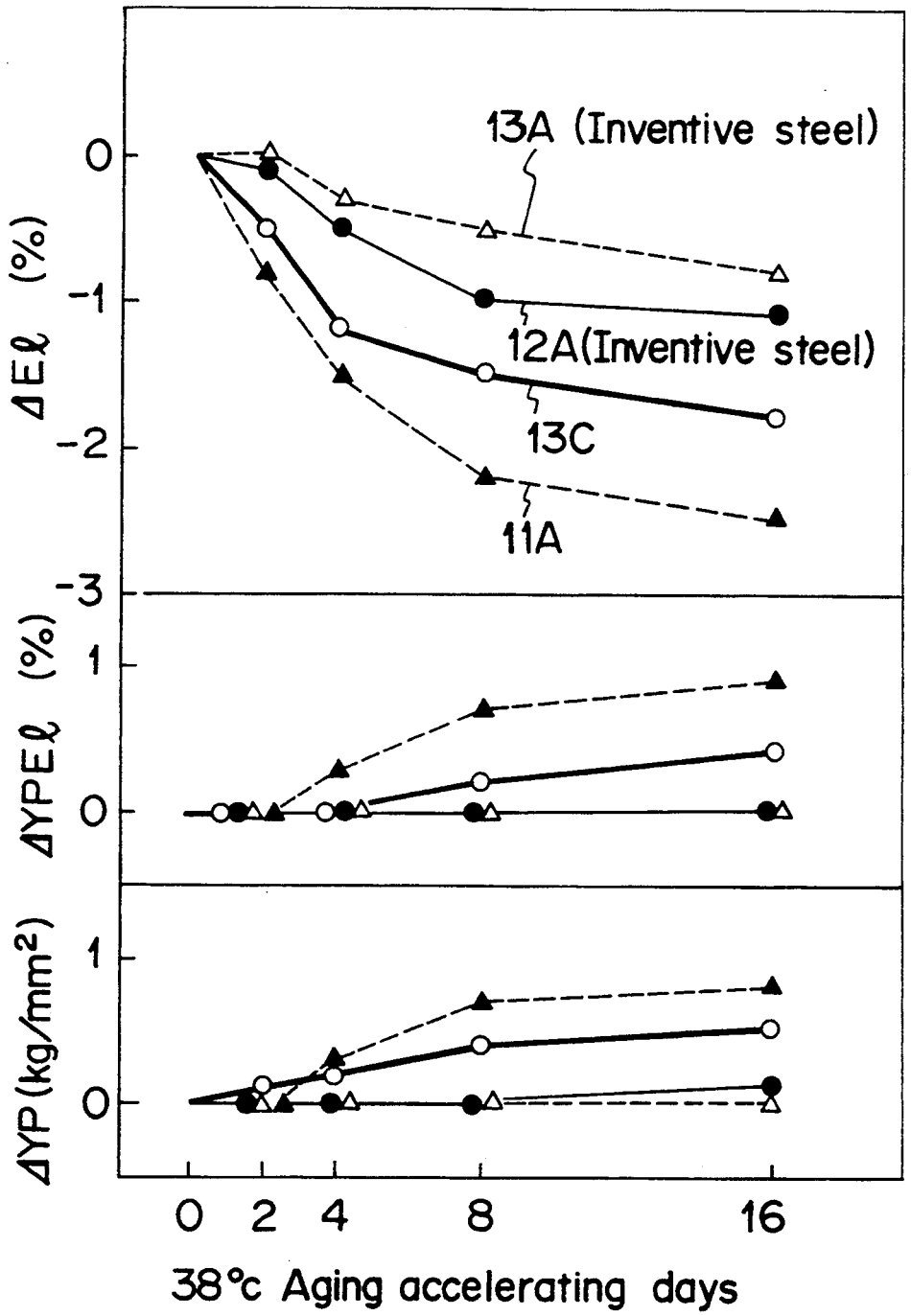
FIG. 2 is a graph showing changes of mechanical properties in aging acceleration tests at the temperature of 38° C. between the inventive steel materials and the conventional ones.

In order to investigate aging behaviours in the samples in Example 2, aging acceleration tests of 38° C. were made to 11A, 12A, 13A and 13B in Table 3. FIG. 2 shows changings of the mechanical properties by the aging acceleration tests of 38° C.

As can be seen from Example 1, the mechanical properties after the temper rolling are most excellent in the range of 0.01 to 0.03%C. When C≧0.01%, the aging index for appreciating the aging resistibility shows the low value. In regard to the heating cycle of the continuous annealing, the aging index is apparently lowered by heating above $A_1$ transformation point and rapidly cooling therefrom.

Depending upon the proper range of C content and the proper heating cycle of the continuous annealing, it is confirmed that the cold rolled steel sheet having the same mechanical properties as the box annealed Al killed steel may be actually produced through the continuous annealing process with respect to the products made in the working field, too, as shown in Example 2. The continuously annealed materials of the present invention do not show recovery of yield point elongation at all in the test results of the aging acceleration of 38° C.×16 days ("38° C.×16 days" corresponds to about 20° C.×4 months), and therefore such steels may be judged as actual non-aging steels.

We claim:

1. A continuous annealing process of producing cold rolled mild steel sheet excellent in deep drawability and aging resistibility, comprising making an Al-killed steel slab comprising 0.015 to 0.03 weight % C, 0.05 to 0.30 weight % Mn, 0.020 to 0.100 weight % sol.Al, not more than 0.0050 weight % N and the rest being Fe and unavoidable impurities, hot rolling the slab at temperatures of more than 830° C., cold rolling after coiling the hot rolled steel, and in a continuous annealing line, maintaining the steel at a temperature between the $A_1$ and the $A_3$ transformation points for more than 10 seconds, cooling said steel from above the $A_1$ transformation point at a cooling rate of more than 200° C./sec, and overaging by maintaining it at a temperature of from 300° to 500° C. for more than 30 seconds, whereby a continuously annealed cold rolled martensite-containing ferrite mild steel having excellent deep drawing characteristics and excellent resistance to deterioration of mechanical properties during aging thereby retaining the excellent deep drawing characteristics is formed.

2. The process of claim 1, wherein said steel also contains from 0.0005 to 0.0050 weight %B.

3. The process of claim 1 wherein said hot rolled steel is coiled at a temperature above 650° C. and then cold rolled.

4. The process of claim 2 wherein said hot rolled steel is coiled at a temperature above 650° C. and then cold rolled.

5. The process of claim 3 wherein said cold rolling is carried out to provide a cold reduction of more than 60%.

6. The process of claim 4 wherein said cold rolling is carried out to provide a cold reduction of more than 60%.

7. The process for producing steel of good deep drawing characteristics which comprises subjecting Al-killed steel slab of a composition consisting essentially of about 0.015 to 0.03 weight % carbon, about 0.05 to 0.30 weight % manganese, not more than about 0.005 weight % nitrogen, about 0.02 to 0.10 weight % soluble aluminum, and the balance essentially iron to hot rolling at temperatures of more than 830° C. to produce hot rolled strip, coiling said hot rolled strip at a temperature above about 650° C., cold rolling said strip with a cold reduction of more than 60%, annealing said cold rolled strip by continuous annealing with heating at a temperature between the $A_1$ and $A_3$ transformation points being maintained for more than 10 seconds to complete recrystallization, rapidly cooling said annealed strip from a temperature above 650° C. at a cooling rate of more than 200° C./sec., then overaging the strip at a temperature between 300° C. and 500° C. for more than 30 seconds to provide in said strip a yield strength of about 17.6 to about 20 kg/mm$^2$, a tensile strength of about 30.7 to about 32 kg/mm$^2$, an elongation of about 47.8 to about 50%, an aging index of about 1.6 to about 1.9 kg/mm$^2$ and an $\bar{r}$ value of about 1.67 to about 1.75, said steel having god deep drawability and high resistance to aging.

8. The process in accordance with claim 7 wherein said steel contains about 0.0005 weight % to about 0.005 weight % boron.

9. The process in accordance with claim 7 wherein the temperature at the start of rapid cooling is above about 650° to 750° C.

10. The process of claim 1 wherein said steel consists essentially of 0.015 to 0.03 weight % C, 0.05 to 0.30 weight % Mn, 0.020 to 0.100 weight % sol.Al, 0.0020 to 0.0050 weight % N, 0.01 to 0.02 weight % Si, 0.010 to 0.019 weight % P, 0.010 to 0.021 weight % S and the remainder being Fe.

11. The process of claim 2 wherein said steel consists essentially of 0.015 to 0.03 weight % C, 0.05 to 0.30 weight % Mn, 0.020 to 0.100 weight % sol.Al, 0.0020 to 0.0050 weight % N, 0.01 to 0.02 weight % Si, 0.010 to 0.019 weight % P, 0.010 to 0.021 weight % S, 0.0005 to 0.0050 weight % B and the remainder being Fe.

12. The process of claim 11 wherein the steel consists essentially of 0.0020 weight % C, 0.02 weight % Si, 0.15 weight % Mn, 0.011 weight % , 0.020 weight % S, 0.0033 weight % sol.Al, 0.0022 weight % B and the remainder being Fe.

13. The process of claim 12 wherein the strip has a yield strength of 17.6 kg/mm$^2$, a tensile strength of 30.7 kg/mm$^2$, an elongation of 47.8%, an aging index of 1.9 kg/mm$^2$, and an r value of 1.69.

14. The process of claim 2 wherein the hot rolling is carried out at a temperature of 870° C., the coiling is carried out with a strip at a temperature of 700° C., the heating step in the annealing is carried out at a temperature of 850° C. and the quenching step in the annealing is carried out at a temperature of 650° C.; and the overaging is carried out at a temperature of 350° C. for 2 minutes.

15. A continuous annealing process of producing a cold rolled mild steel sheet excellent in deep drawability and aging resistibility, comprising making an Al-killed steel slab comprising 0.01 to 0.03 weight % C, 0.05 to 0.30 weight % Mn, 0.020 to 0.100 weight % sol.Al, not more than 0.0050 weight % N, 0.0005 to 0.0050 weight % B and the rest being Fe and unavoidable impurities, hot rolling the slab at temperatures of more than 830° C., cold rolling after coiling the hot rolled steel, and in a continuous annealing line, maintaining the steel at a temperature between the $A_1$ and the $A_3$ transformation points for more than 10 seconds, cooling said steel from above the $A_1$ transformation point at a cooling rate of more than 200° C./sec, and overaging at a temperature of from 300° to 500° C. for more than 30 seconds.

16. A steel having desirable drawing characteristics produced by the process of claim 7.

17. A process for producing steel of good deep drawing and high resistance to aging consisting essentially of subjecting an Al-killed steel slab of a composition consisting essentially of about 0.015 to 0.03% carbon, about 0.05 to 0.30% manganese, not more than about 0.005% nitrogen, about 0.02 to 0.10% soluble aluminum, and the balance being essentially iron to hot rolling at a temperature of more than 830° C. to produce a hot rolled strip, coiling said hot rolled strip at a temperature above about 650° C., cold rolling said strip with a cold reduction of more than 60%, annealing said cold rolled strip by continuous annealing with heating at a temperature between the $A_1$ and $A_3$ transformation points for more than 10 seconds to complete recrystallization, rapidly cooling said annealed strip from a temperature above 650° C. at a cooling rate of more than 200° C./sec., overaging the strip at a temperature between 300° C. and 500° C. for more than 30 seconds to provide in said strip a yield strength of about 17.6 to about 20 kg/mm$^2$, a tensile strength of about 30.7 to about 32 kg/mm$^2$, an elongation of about 47.8 to about 50%, an aging index of about 1.6 to about 1.9 kg/mm$^2$ and an $\bar{r}$value of about 1.67 to about 1.75.

18. A continuous annealing process for producing a cold rolled mild steel sheet excellent in deep drawability and aging resistibility, consisting essentially of forming an Al-killed steel slab comprising 0.01 to 0.03 weight % C., 0.05 to 0.30 weight % Mn, 0.020 to 0.100 weight % sol.Al, not more than 0.0050 weight % N, 0.0005 to 0.0050 weight % B and the remainder being Fe and unavoidable impurities, hot rolling the steel slab at a temperature of more than 830° C., coiling the hot rolled steel, cold rolling said coiled hot rolled steel, maintaining the steel at a temperature between the $A_1$ and the $A_3$ transformation points for more than 10 seconds in a continuous annealing line, cooling said steel from above about 650° C. at a cooling rate of more than 200° C./sec and overaging at a temperature of from 300° to 500° C. for more than 30 seconds.

* * * * *